US009771639B2

(12) United States Patent
Zhang et al.

(10) Patent No.: US 9,771,639 B2
(45) Date of Patent: Sep. 26, 2017

(54) HIGH-STRENGTH AND HIGH-TOUGHNESS STEEL PLATE WITH YIELD STRENGTH OF 700 MPA AND METHOD OF MANUFACTURING THE SAME

(75) Inventors: Aiwen Zhang, Shanghai (CN); Sihai Jiao, Shanghai (CN); Qingfeng Zhang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 652 days.

(21) Appl. No.: 14/129,103

(22) PCT Filed: May 25, 2012

(86) PCT No.: PCT/CN2012/076052

§ 371 (c)(1),
(2), (4) Date: Dec. 23, 2013

(87) PCT Pub. No.: WO2013/044641

PCT Pub. Date: Apr. 4, 2013

(65) Prior Publication Data

US 2014/0116578 A1 May 1, 2014

(30) Foreign Application Priority Data

Sep. 26, 2011 (CN) ..... 2011 1 0288952

(51) Int. Cl.

| | |
|---|---|
| ***C22C 38/02*** | (2006.01) |
| ***C22C 38/50*** | (2006.01) |
| ***C21D 8/02*** | (2006.01) |
| ***C22C 38/00*** | (2006.01) |
| ***C22C 38/04*** | (2006.01) |
| ***C22C 38/06*** | (2006.01) |
| ***C22C 38/44*** | (2006.01) |
| ***C21D 1/28*** | (2006.01) |
| ***C21D 1/30*** | (2006.01) |

(52) U.S. Cl.

CPC ..... *C22C 38/50* (2013.01); *C21D 1/28* (2013.01); *C21D 1/30* (2013.01); *C21D 8/021* (2013.01);

(Continued)

(58) Field of Classification Search

CPC ..... C21D 8/02; C21D 8/0263; C22C 38/02; C22C 38/50

(Continued)

(56) References Cited

U.S. PATENT DOCUMENTS

2012/0031528 A1 2/2012 Hayashi et al.

FOREIGN PATENT DOCUMENTS

CN 1840723 A 10/2006
CN 1840724 A 10/2006

(Continued)

OTHER PUBLICATIONS

English language translation of JP2009235524. Translation date unknown.*

The International Search Report from PCT/CN2012/076059, dated Sep. 6, 2012 (*English version only*).

*Primary Examiner* — Brian Walck

(74) *Attorney, Agent, or Firm* — Kilpatrick Townsend & Stockton LLP

(57) ABSTRACT

The present invention relates to a high-strength high-toughness steel plate and a method of manufacturing the steel plate. The steel plate contains the following chemical compositions, by weight, C: 0.03-0.06%, Si≤0.30%, Mn: 1.0-1.5%, P≤0.020%, S≤0.010%, Al: 0.02-0.05%, Ti: 0.005-0.025%, N≤0.006%, Ca≤0.005%, and more than one of Cr≤0.75%, Ni≤0.40%, Mo≤0.30%, other compositions being Ferrum and unavoidable impurities. The finished steel plate, with a thickness of 6-25 mm, has a yield strength of ≥700 MPa, an elongation A50 of ≥18%, Akv at −60° C. of ≥150 J and good cool bending property.

21 Claims, 1 Drawing Sheet

(52) U.S. Cl.
CPC ..... *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01)

(58) Field of Classification Search
USPC ..... 148/334, 335, 541, 547; 420/8, 104–112
See application file for complete search history.

(56) References Cited

FOREIGN PATENT DOCUMENTS

| | | | | |
|---|---|---|---|---|
| CN | 101649420 | A | | 2/2010 |
| CN | 101985725 | A | | 3/2011 |
| CN | 102021494 | A | | 4/2011 |
| JP | S57134514 | A | | 8/1982 |
| JP | 04-285119 | A | | 10/1992 |
| JP | H1180832 | A | | 3/1999 |
| JP | 2005036295 | A | | 2/2005 |
| JP | 2009235524 | A | * | 10/2009 |
| JP | 2010236046 | A | | 10/2010 |
| JP | 2011-052293 | A | | 3/2011 |
| JP | 2011074443 | A | * | 4/2011 |
| JP | 2011-140672 | A | | 6/2011 |
| WO | 9905335 | A1 | | 2/1999 |
| WO | 0039352 | A2 | | 7/2000 |
| WO | 2009048838 | A1 | | 4/2009 |
| WO | 2010074473 | A2 | | 7/2010 |
| WO | 2010/137317 | A1 | | 12/2010 |
| WO | WO 2011027900 | | * | 3/2011 |

* cited by examiner

HIGH-STRENGTH AND HIGH-TOUGHNESS STEEL PLATE WITH YIELD STRENGTH OF 700 MPA AND METHOD OF MANUFACTURING THE SAME

FIELD OF THE INVENTION

The present invention relates to a high-strength high-toughness steel plate, and in particular to a high-strength high-toughness steel plate with yield strength of greater than or equal to 700 MPa, and a method of manufacturing the same. The steel plate of the present invention is of good low-temperature toughness, and suitable for making impact-resistant structural steel plates with high strength and high toughness in industries such as automobiles, engineering machinery, warship hull structures.

BACKGROUND OF THE INVENTION

As an important type of steel, the high-strength low-alloy steel, is applied widely to fields like military industry, automobile industry, mining machinery, engineering machinery, agricultural machinery and railway transportation. With the rapid development of China industry, various military and civil equipments become more complicated, larger and lighter, which requires high-strength low-alloy steel plates used for making the equipments, not only to be of higher hardness and strength, but also good toughness and forming performance. In recent decades, the research and application of high-strength steel plate develops very fast. This type of steel is developed on basis of high-strength low-alloy weldable steel, and the service life thereof is many times longer than that of traditional structural steel plate; the manufacturing process thereof is simple, which normally includes cooling or quenching directly after rolling, or offline quenching and tempering, or controlled rolling and controlled cooling to strengthen.

In traditional process of manufacturing high-strength low-alloy steel for automobiles, engineering machinery, and warship hull structures, many expensive alloy elements such as Cu, Ni, Cr and Mo are added, which cost much. Currently, high-strength steel begins to develop in two directions, one of which is low-cost production, and another is high cost with high performance. In China, when producing high-strength steels, steel mills prefer to add alloy elements like V, Ti, Cr, Si, Mn, B, RE which are abundant in home, and the addition amount is normally ≤3%. As to those high-strength steels with higher strength in warship hull structures, automobiles, mining machinery, engineering machinery and the like—for instance, steel plates with yield strength of 700 MPa,—elements such as Cu, Ni, Cr, Mo and the like are further added to improve its property. Although the yield strength of the steel plate is up to 700 MPa, its low-temperature toughness is not high enough for military warship hull structures and civil equipments Which have strict requirements on low-temperature impact at −60° C. or even −80° C. Now, in China, high-strength steel with yield strength of above 700 MPa, are still dependent predominantly on imports.

HSLA−80/100 in United States Military Standard MILS-24645A-SH relates to a type of steel, in which C≤0.06%, Si≤0.04%, Mn: 0.75-1.05%, P≤0.020%, S≤0.006%, Cu: 1.45-1.75%, Ni: 3.35-3.65%, Cr: 0.45-0.75%, Mo: 0.55-0.65%, Nb: 0.02-0.06%, minimum Ceq is 0.67 and plate thickness is ≤102 mm, which adopts the alloying design of low carbon or even ultra-low carbon (C≤0.06%), to ensure the excellent weldability and low-temperature toughness. In the steel, high content of copper and nickel are added, wherein owing to the age hardening of copper, high strength can be obtained without obvious damage to its toughness and plasticity. It has a yield strength of 690-860 MPa, an elongation of 18%, an transverse $A_{kv}$ at −18°0 C. of 108J and an transverse $A_{kv}$ at −84° C. of 81J. Due to that a lot of expensive alloy elements are added therein, it becomes very costly.

Now, in patent documents relating to high-strength high-toughness steel plates with yield strength of about or above 700NIPa, which have been published, WO 200039352A, for example, discloses a low-temperature steel, wherein high-strength steel with tensile strength of above 930 MPa and good low-temperature toughness, is obtained through adding low content of carbon (0.03-0.12%) and high content of nickel (no less than 1.0%) and adopting a low cooling rate (10° C./s).

WO 9905335A discloses a high-strength steel with relatively low content of carbon (0.05-0.10%) and high content of Mn, Ni, Mo and Nb. After rolling, the steel is only quenched, but not tempered, such that the tensile strength thereof can be up to above 830 MPa, and the minimum Charpy impact energy at −40° C. is 175J.

Currently, it is still necessary to provide a medium steel plate with high strength and toughness which is relatively economical and can be applied widely in industries such as automobiles, engineering machinery and warship hull structures.

SUMMARY OF THE INVENTION

The objective of the present invention is to provide a high-strength high-toughness steel plate with yield strength of above 700 MPa, particularly to provide a medium steel plate having thickness of 6-25 mm.

To achieve the aforementioned objective, the medium steel plate of the present invention contains the following chemical compositions, by weight, C: 0.03-0.06%, S≤0.30%, Mn: 1.0-1.5%, P≤0.020%, S≤0.010%, Al: 0.02-0.05%, Ti: 0.005-0.025%, N≤0.006%, Ca≤0.005%, and more than one of Cr≤0.75%, Mo≤0.30%, other compositions being Ferrum and unavoidable impurities.

Preferably, C is 0.031-0.059% by weight.

Preferably, Si is 0.03-0.30% by weight.

Preferably, Mn is 1.02-1.5% by weight.

Preferably, P is ≤0.015% by weight.

Preferably, S is ≤0.005% by weight.

Preferably, Al is 0.02-0.046% by weight.

Preferably, Ni is 0.10-0.40% by weight, more preferably, 0.13-0.36%.

Preferably, Cr is 0.3-0.75% by weight, more preferably, 0.32-0.75%.

Preferably, Mo is 0.10-0.30% by weight, more preferably. 0.13-0.26%.

Preferably, Ti is 0.01-0.025% by weight.

Preferably, N is ≤0.005% by weight.

In the present invention, unless otherwise specified, the content herein always indicates the percentage by weight.

The structures of the steel plate are tempered martensite and dispersed carbides.

Another objective of the present invention is to provide a method of manufacturing such a medium steel plate with high strength and high toughness, which comprises:

after vacuum degassing treatment, continuous-casting or die-casting molten steel, and if the molten steel is die-casted, blooming it into a billet:

heating the continuous casting slab or billet at temperature of 1100-1250° C., then one-pass or multi-pass rolling it in austenite recrystallization zone, with the total reduction ratio being ≤70% and the rolling finishing temperature being ≤860° C.;

water-cooling rapidly the rolled steel plate at speed of 15-50° C./s is to the temperature range 200-300° C., then air-cooling it for 5-60 s;

after the cooled steel plate entering an online heating furnace, rapidly heating it at speed of 1-10° C./s to 450-550° C., tempering it for 15-45 s, then air-cooling it outside the furnace.

Preferably, the rolling finishing temperature is 860-900° C.

Preferably, after the cooled steel plate entering an online heating furnace, rapidly heating it at speed of 1-10° C. is to 450-500° C., tempering it for 15-45 s, then air-cooling it outside the furnace.

Preferably, the online heating furnace is an induction heating furnace.

According to the present invention, the speed of cooling the rolled steel plate is no less than 15° C./s, the aim of which is to ensure obtaining martensite-type structures and avoiding the temperature range of forming bainite structures. The upper limit value of the cooling speed is confined by cooling ability of cooling equipments and the finish cooling temperature, and difficult to rise very high, hence the present invention uses the cooling speed range of 15-50° C./s.

In the present invention, by using, the appropriate component design, heating, controlled rolling, rapid cooling and tempering process, the steel plate is fine-grain, phase-change, and precipitation strengthened, and improved on the strength and hardness. It also features high low-temperature toughness, the structures of which present tempered martensite and dispersed carbides. The steel plate with a thickness of 6-25 mm has a yield strength of ≥700 MPa, an elongation $A_{50}$ of ≥18%, $A_{kv}$ at −60° C. of ≥150J and good cool bending property, which meets the high demand of high-strength high-toughness steel plates in industries of automobiles,. engineering machinery and warship hull structures and the like. It is appropriate for producing high-strength high-toughness members which are needed in these industries. As the steel plate features high strength, high low-temperature toughness and good bending property, it is convenient for users to machine to shape.

DETAILED DESCRIPTION OF THE INVENTION

Figure 1:
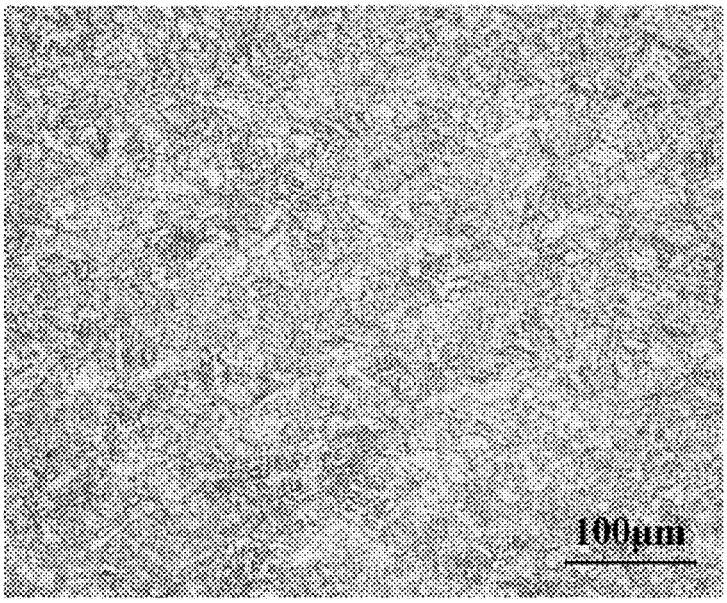
FIG. 1 is a typical metallographic structure photo of a high-strength steel plate with a thickness of 6 mm of the embodiment 1 according to the present invention.

Hereinafter, the features and properties of the present invention will be described in details in conjunction with the embodiments.

To achieve the objective of the present invention, the major chemical components of the steel plate are controlled as follows.

Carbon: carbon is the key element to guarantee the strength of steel plate. For obtaining steel plates constituted mainly of martensite, carbon is the most important element, which can significantly improve hardenability of the steel plates. The increment of carbon causes the strength and hardness to improve and plasticity to decline, so if the steel plate needs both high strength and toughness, the carbon content has to be considered comprehensively. In order to ensure an excellent weldability and a fine low-temperature toughness, the carbon content in steel should be decreased to below 0.06%. With regard to the yield strength of 700 MPa in the present invention, low content of carbon, that is, 0.03-0.06% is adapted for relatively high low-temperature impact toughness.

Silicon: addition of silicon in steel can improve the purity and deoxygenation of steel. Silicon in steel contributes to solid solution strengthening, but excessive silicon may cause that When the steel plate is heated, the oxide skin thereof may become highly viscous, and it is difficult to descale after the steel plate exiting from furnace, thereby resulting in a lot of red oxide skins on the rolled steel plate, i.e. the surface quality is bad; besides, the excessive silicon may also be harmful to the weldability of steel plate. In consideration of all the factors above, the content of silicon in the present invention is less than or equal to 0.30%.

Manganese: manganese is used for stabilizing austenite structures, and this capacity is second only to the alloy element nickel. It is an inexpensive element for stabilizing austenite structures and strengthening alloying. At the same time, manganese can improve the steel hardenability, and decrease the critical cooling rate of forming martensite. However, manganese has a high segregation tendency, so its content should not be very high, generally, no more than 2.0% in low-carbon microalloyed steel. The amount of manganese added depends mostly on the strength level of the steel. The manganese content in the present invention should be controlled within 1.0-1.5%. Furthermore, manganese together with aluminum in steel contributes to deoxygenating.

Sulphur and phosphorus: in steel, sulphur, manganese and the like are combined into a. plastic inclusion, manganese sulfide, which is harmful to the transverse ductility and toughness thereof, thus the sulphur content should be as low as possible. The element, phosphorus, is also one of the harmful elements, which seriously impairs the ductility and toughness of steel plates. In the present invention, both sulphur and phosphorus are unavoidable impurity elements that should be as few as possible. In view of the actual steelmaking conditions, the present invention requires that P is ≤0.020%, S is ≤0.010%.

Aluminum: in the present invention, aluminum acts as a strong deoxidization element. To ensure the oxygen content as low as possible, the aluminum content should be controlled within 0.02-0.04%. After deoxidization, the remaining aluminum is combined with nitrogen in steel to form AlN precipitation which can improve the strength and during heat treatment, refine the austenitic grains therein.

Titanium: titanium is a strong carbide-forming element. The addition of trace Ti in steel is good for stabilizing N, and TiN formed can also make austenitic grains of billets, during being heated, not coarsening too much, whereas refining the original austenitic grains. In steel, titanium may be combined with carbon and sulphur respectively to form TiC, TiS, $Ti_4C_2S_2$ and the like. Which exist in the forms of inclusion and second-phase particles. When welding, these carbonitride precipitations of titanium are also capable of preventing the growth of grains in heat-affected zone, thereby improving the welding performance. In the present invention, the titanium content is controlled within 0.005-0.025%.

Chromium: Chromium promotes hardenability and tempering resistance of steel. Chromium exhibits good solubility in austenite and can stabilize the austenite. After quenching, much of it dissolves in martensite and subsequently in tempering process, precipitates carbides such as $Cr_{23}C_7$, $Cr_7C_3$, which improves the strength and hardness of steel. For keeping the strength level of steel, chromium may replace manganese partly and weaken the segregation tendency thereof. Combining with the fine: carbides precipitated via online rapid induction heat tempering, it can reduce the content of corresponding alloy elements. Accordingly, in the present invention, no more than 0.75%, preferably 0.3-0.75% of chromium may be added.

Nickel: nickel is the element used for stabilizing austenite, with no remarkable effect on improving strength. Addition of nickel in steel, particularly in quenched and tempered steel, can promote toughness, particularly low-temperature: toughness thereof, but it is an expensive alloy element, so the present invention may add no more than 0.40%, preferably 0.10-0.40%, and more preferably; 0.13-0.36% of nickel.

Molybdenum: molybdenum can significantly refine grains, and improve the strength and toughness of steel. It reduces tempering brittleness of steel while precipitating very fine carbides during tempering, which can remarkably strengthen the matrix thereof. Because molybdenum is a kind of strategic alloy element which is very expensive, in the present invention, no more than 0.30%, preferably 0.10-0.30%, preferably 0.13-0.26% of molybdenum is added.

Calcium: the addition of calcium in steel is, mainly, to change the form of the sulfides, thereby improving the performance of the steel in the thickness and transverse directions, and cold bending property. For steel with very low sulfur content, calcium treatment may be not necessary. In the present invention, calcium treatment depends on the content of sulfur. The content of calcium is ≤0.005%.

The following processes have effects on products of the present invention:

bessemerizing and vacuum treatment: its aim is to guarantee that molten steel contains basic components, to remove harmful gases such as oxygen, hydrogen therein, to add necessary alloy elements such as manganese, titanium, and to adjust them;

continuous casting or die casting: its aim is to ensure that the blank has homogeneous inner components and good surface quality, wherein static ingots formed by die casting need to be rolled into billets;

heating and rolling: heating the continuous casting slab or billet at temperature of 1100-1250° C. to, on one hand, obtain uniform austenite structure, and on the other hand, dissolve. partly the compounds of alloy elements like titanium, chromium, molybdenum. One-pass or multi-pass rolling it in austenite recrystallization temperature range into steel plate, with the total reduction ratio being, no less than 70%, and the rolling finishing temperature being no less than 860° C.;

rapid cooling: rapidly water-cooling the rolled steel plate at speed of 15-50° C./s to the temperature range 200-300° C. and air-cooling it for 5-60 s; dining the rapid cooling, most alloy elements are solved into martensite;

online tempering: after the cooled steel plate entering an online heating furnace, heating it rapidly at speed of 1-10° C./s to 450-550° C., and tempering it for 15-45 s, then air-cooling it outside the furnace. The tempering helps to eliminate the internal stress produced in steel plate during. quenching as well as the niicrocracks in or between martensite strips, and precipitate dispersively part of carbides to strengthen, therefore improving the ductility, toughness and cool bending property thereof.

In the present invention, by using the appropriate component design, heating, controlled rolling, rapid cooling and self tempering process, the steel plate is fine-grain, phase-change, and precipitation strengthened, and improved on the strength and hardness. It also features high low-temperature toughness, the structures of which present tempered martensite and dispersed carbides. The steel plate with a thickness of 6-25 mm has a yield strength of ≥700 MPa, an elongation $A_{50}$ of ≥18%, $A_{kv}$ at −60° C. of ≥150J and good cool bending property, which meets the high demand of high-strength high-toughness steel plates in industries of automobiles, engineering machinery and warship hull structures and the like.

Embodiments

Embodiment 1

Molten steel smelt in accordance with the matching ratio of table 1, after vacuum degassing, is continuous-casted or die-casted, obtaining a slab of 80 mm thick. The slab is heated at 1200° C., and multi-pass rolled in the austenite recrystallization temperature range into steel plate with a thickness of 6 mm, wherein the total reduction rate is 94%, the rolling finishing temperature is 880° C., then it is cooled to 220° C. at speed of 50° C./s, rapidly heated online to 450° C. and tempered, after which the steel plate is air-cooled to ambient temperature.

FIG. 1 shows part of the metallographic structure of steel plate in the embodiment.

Table 1shows the detailed components in embodiments 2-5, Table 2shows the process parameters thereof, and Table 3shows the properties of steel plates obtained in all embodiments.

TABLE 1

Chemical Components and Ceq (wt %) in Embodiments 1-5 of The Present Invention

| Embodiments | C | Si | Mn | P | S | Al | Ni | Cr | Mo | Ti | Ca | N | Ceq* |
|---|---|---|---|---|---|---|---|---|---|---|---|---|---|
| 1 | 0.031 | 0.30 | 1.50 | 0.009 | 0.003 | 0.020 | 0.31 | 0.35 | 0.18 | 0.015 | 0.0008 | 0.0040 | 0.41 |
| 2 | 0.044 | 0.25 | 1.45 | 0.009 | 0.003 | 0.025 | 0.20 | 0.45 | 0.20 | 0.02 | 0.0010 | 0.0036 | 0.43 |
| 3 | 0.050 | 0.19 | 1.21 | 0.008 | 0.003 | 0.033 | 0.21 | 0.62 | 0.24 | 0.014 | 0.0008 | 0.0035 | 0.44 |
| 4 | 0.055 | 0.10 | 1.20 | 0.010 | 0.003 | 0.035 | 0.15 | 0.65 | 0.15 | 0.025 | 0.0012 | 0.0041 | 0.43 |
| 5 | 0.060 | 0.03 | 1.05 | 0.010 | 0.004 | 0.045 | 0.35 | 0.75 | 0.25 | 0.010 | 0.0010 | 0.0031 | 0.46 |

*Ceq = C + Mn/6 + (Cr + Mo + V)/5 + (Ni + Cu)/14

TABLE 2

Related Process Parameters and Steel Plate Thickness in Embodiments 1-5 of The Present Invention

| Embodiments | Heating Temperature/ ° C. | Rolling finishing Temperature/ ° C. | Reduction Rate/% | Cooling Speed/ ° C./s | Final Cooling Temperature/ ° C. | Tempering Temperature/ ° C. | Tempering Time/s | Plate Thickness/ mm |
|---|---|---|---|---|---|---|---|---|
| 1 | 1250 | 900 | 94 | 50 | 200 | 450 | 45 | 6 |
| 2 | 1200 | 880 | 88 | 40 | 250 | 450 | 30 | 11 |
| 3 | 1150 | 860 | 81 | 25 | 280 | 450 | 15 | 15 |
| 4 | 1150 | 860 | 75 | 20 | 300 | 500 | 15 | 20 |
| 5 | 1100 | 860 | 70 | 18 | 300 | 550 | 15 | 25 |

Test 1: Mechanical Property

According to GB/T228-2002 Metallic materials—Tensile testing at ambient temperature and GB 2106-1980 Metallic materials—Chaney v-notch impact test, the result thereof is shown in Table 3.

TABLE 3

Mechanical Properties and Structures of The Steel Plates of The Present Invention

| Embodiments | Yield Strength/ MPa | Tensile Strength/ MPa | Elongation $A_{50}$/% | −60° C. $A_{kv}$ Impact Value/J | Transverse Cool Bending d = 2a, 180° | Structures |
|---|---|---|---|---|---|---|
| 1 | 830 | 933 | 22 | 161 (converted by half size) | PASS | Tempered Martensite + Dispersed Carbides |
| 2 | 815 | 895 | 24 | 185 | PASS | Tempered Martensite + Dispersed Carbides |
| 3 | 750 | 925 | 74 | 231 | PASS | Tempered Martensite + Dispersed Carbides |
| 4 | 740 | 920 | 23 | 222 | PASS | Tempered Martensite + Dispersed Carbides |
| 5 | 765 | 955 | 25 | 212 | PASS | Tempered Martensite + Dispersed Carbides |

Test 2: Bending Property

According to GB/T 232-2010 Metallic materials—Bend test, the steel plates in embodiments 1-5 are cold-bent transversely for d=2a, 180°, with the result shown in Table 3 in which all the steel plates are complete, without any surface crack.

Test 3: Metallographic Structure

FIG. 1 is the schematic view of the metallographic structure of the steel plate with a thickness of 6 mm in embodiment 1 according to the present invention.

Figure 2:
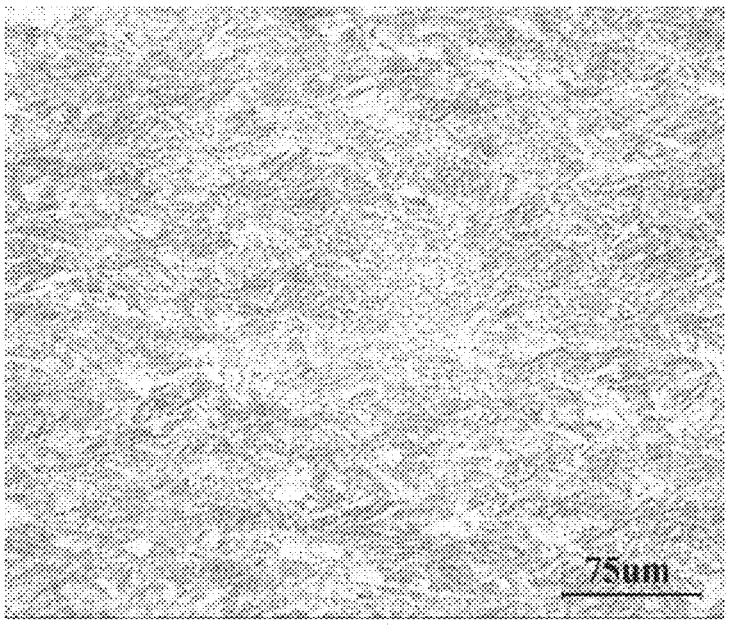
FIG. 2 is a typical metallographic structure photo of a high-strength steel plate with a thickness of 25 mm of the embodiment 5 according to the present invention.

FIG. 2 is the schematic view of the metallographic structure of the steel plate with a thickness of 25 mm in embodiment 5 according to the present invention.

From the figures, it is known that the structures of steel plate are tempered martensite and dispersed carbides.

Similar metallographic structures can be gained from other embodiments.

From the above embodiments, it can seen that by using the components and processing parameters, the finished steel plate with a thickness of 6-25 mm has a yield strength of ≥700 MPa, an elongation $A_{50}$ of ≥18%, $A_{kv}$ at −60° C. of ≥150J and good cool bending property, the structures of which present tempered martensite and dispersed carbides. It meets the high demand of high-strength high-toughness steel plates in related industries. The product is appropriate for industries such as warship hull structures, automobiles, engineering machinery and the like, and is of wide application value and market prospect.

Through using fewer alloy elements, new online quenching and tempering processes, the present invention achieves more excellent performance than HSLA-100 (with a yield strength of 690-860MPa an elongation of 18%, transverse $A_{kv}$ at −18° C. of 108J, and transverse $A_{kv}$ at −84° C. of 81J), that is the steel plate has a longitudinal yield strength of 700-860MPa an elongation $A_{50}$ of 20%, longitudinal $A_{kv}$ at −60° C. of 200J and transverse $A_{kv}$ at −84° C. of 151J, and its carbon equivalent Ceq is far lower than HSLA-100steel (its minimum Ceq is 0.67), which indicates that the steel plate of the present invention is of better weldability. Therefore, the steel plate of the present invention, comparing with American HSLA-100, has remarkable advantages on cost and technology.

The invention claimed is:

1. A high-strength high-toughness steel plate, comprising the following chemical compositions, by weight, C: 0.03-0.06%, Si≤0.30%, Mn: 1.0-1.5%, P≤0.020%, S≤0.010%, Al: 0.02-0.05%, Ti: 0.005-0.025%, N≤0.006%, Ca≤0.005%, and more than one of Cr, Ni and Mo, wherein Cr≤0.75%, Ni≤0.40%, and Mo≤0.30%, other compositions being Ferrum and unavoidable impurities, wherein the high-strength high-toughness steel plate has a thickness of 6-25 mm, a yield strength of ≥700MPa, an elongation $A_{50}$ of ≥18%, and an Akv at −60° C. of ≥150J, and wherein the high-strength high-toughness steel plate structure comprises mainly tempered martensite and dispersed carbides and with no bainite structure.

2. The high-strength high-toughness steel plate according to claim 1, characterized in that C is 0.031-0.059% by weight.

3. The high-strength high-toughness steel plate according to claim 1, characterized in that Si is 0.03-0.30% by weight.

4. The high-strength high-toughness steel plate according to claim 1, characterized in that Mn is 1.02-1.5% by weight.

5. The high-strength high-toughness steel plate according to claim 1, characterized in that P is ≤0.015% by weight.

6. The high-strength high-toughness steel plate according to claim 1, characterized in that S is ≤0.005% by weight.

7. The high-strength high-toughness steel plate according to claim 1, characterized in that Al is 0.02-0.046% by weight.

8. The high-strength high-toughness steel plate according to claim 1, characterized in that Ni is 0.10-0.40%.

9. The high-strength high-toughness steel plate according to claim 1, characterized in that Cr is 0.3-0.75%.

10. The high-strength high-toughness steel plate according to claim 1, characterized in that Mo is 0.10-0.30%.

11. The high-strength high-toughness steel plate according to claim 1, characterized in that Ti is 0.01-0.025% by weight.

12. The high-strength high-toughness steel plate according to claim 1, characterized in that N is ≤0.005% by weight.

13. A manufacturing method of the high-strength high-toughness steel plate according to claim 1, comprising:

after vacuum degassing treatment, continuous-casting or die-casting molten steel, and if the molten steel is die-casted, blooming it into a billet;

heating the continuous casting slab or billet at temperature of 1100-1250° C., then one-pass or multi-pass rolling it in austenite recrystallization zone, with the total reduction ratio being ≥70% and the rolling finishing temperature being ≥860° C.;

water-cooling rapidly the rolled steel plate at a rate of 15-50° C./s to the temperature range 200-300° C., then air-cooling it for 5-60 s;

after the cooled steel plate entering an online heating furnace, rapidly heating it at a rate of 1-10° C./s to 450-550° C., tempering it for 15-45 s, then air-cooling it outside the furnace.

14. The method according to claim 13, characterized in that the rolling finishing temperature is 860-900° C.

15. The method according to claim 13, characterized in that after the cooled steel plate entering an online heating furnace, rapidly heating it at a rate of 1-10° C./s to 450-500° C., tempering it for 15-45 s, then air-cooling it outside the furnace.

16. The method according to claim 13, characterized in that the online heating furnace is an induction heating furnace.

17. The high-strength high-toughness steel plate according to claim 1, characterized in that Ni is 0.13-0.36% by weight.

18. The high-strength high-toughness steel plate according to claim 1, characterized in that Cr is 0.32-0.75% by weight.

19. The high-strength high-toughness steel plate according to claim 1, characterized in that Mo is 0.13-0.26% by weight.

20. The high-strength high-toughness steel plate according to claim 1, wherein the structure consists of tempered martensite and dispersed carbides with no bainite structure.

21. The high-strength high-toughness steel plate according to claim 1, wherein the steel plate was cooled at a rate of no less than 15° C./s to avoid bainite formation.

* * * * *